United States Patent [19]

Jinotti

[11] 4,111,416

[45] Sep. 5, 1978

[54] EXERCISER

[76] Inventor: Walter J. Jinotti, 10 Scott St., New Brunswick, N.J. 08902

[21] Appl. No.: 803,878

[22] Filed: Jun. 6, 1977

[51] Int. Cl.[2] ..... A63B 23/04

[52] U.S. Cl. ..... 272/96; 272/141; 272/900

[58] Field of Search ..... 128/25 B; 272/96, 70, 272/136, 141, 135, 900; 267/166, 150, 179; D34/5 K

[56] References Cited

U.S. PATENT DOCUMENTS

| | | | |
|---|---|---|---|
| 1,509,793 | 9/1924 | Thompson | 272/96 |
| 1,587,749 | 6/1926 | Bierly | 272/70 |
| 2,830,816 | 4/1958 | Uhl | 272/96 |
| 3,295,847 | 1/1967 | Matt | 272/141 |
| 3,297,320 | 1/1967 | Benedetto | 272/93 |
| 3,675,912 | 7/1972 | Jardins | 267/166 |
| 3,741,540 | 6/1973 | Shimizu | 272/141 |
| 3,887,180 | 6/1975 | Berman | 272/141 |
| 3,942,791 | 3/1976 | Dawson | 272/96 X |
| 4,056,265 | 11/1977 | Ide | 272/141 |

FOREIGN PATENT DOCUMENTS

| | | | |
|---|---|---|---|
| 1,513,564 | 1/1968 | France | 128/25 B |

*Primary Examiner*—Richard J. Johnson
*Attorney, Agent, or Firm*—Robert A. Green

[57] ABSTRACT

The disclosure is of a leg exerciser comprising a generally rectangular base member and a generally rectangular upper foot-receiving member hinged together along aligned end portions with a spring disposed between them remote from the aligned portions. Leg exercise can be obtained by pumping the upper member down and up regularly against the force of the spring.

14 Claims, 8 Drawing Figures

EXERCISER

BACKGROUND OF THE INVENTION

A portable exerciser is needed to stimulate blood circulation while riding in a car or an airplane or while confined to bed, but no such exercise device is presently known which is as simple in operation and as effective as the present invention.

DESCRIPTION OF THE PREFERRED EMBODIMENTS

Figure 8:
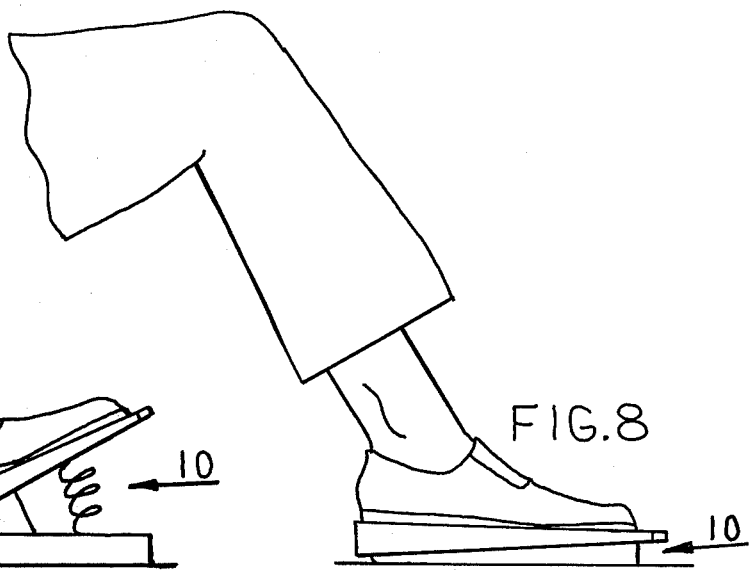

The exerciser of the invention 10 comprises a generally rectangular base member 20 and a generally rectangular upper member 30, both members being pivotally coupled together. The rectangular base member 20 has a rear wall 40, a leading wall 50, a top surface 54, a bottom surface 60, and side walls 62 and 64. At the rear end of the base member, the side walls are provided with tabs 66 which have apertures 68 for a purpose to be described. The upper or foot-receiving member has a rear wall 70, a leading wall 80, a top surface 90, a bottom surface 100, and side walls 102 and 104. The upper member and base member are approximately the same size in area, with the upper being somewhat larger, and they are about the same shape. The two parts are adapted to fit together as shown in FIG. 8, with the base member fitting snugly within the upper member and with the side walls 62 and 64 of the base member inside and adjacent to the side walls 102 and 104 of the upper member. Pins 110 extend through apertures in the side walls of the upper member which are aligned with the apertures 68 in the tabs 66 in the side walls of the base member. The two members can thus pivot with respect to each other about the pins 110.

The top surface of the upper member 30 lies below the top surfaces of the side walls and rear wall to provide a depression 120 for receiving the foot or shoe of the user of the apparatus, and the rear wall 130 thereof is curved to receive the heel of the foot or shoe. The floor of the depression 120, which is the top surface 90, is covered with a rubber pad 140 which has horizontal ridges 150 to permit frictional engagement of the foot therewith.

A cylindrical spring 160 is disposed between the lower surface of the upper member and the upper surface of the base member, with one end being secured to and engaging tabs 170 at the bottom of a circular depression 180 in the base member, and the other end is similarly secured to the lower surface of the upper member. Other securing means for the spring may also be used.

A nylon cord 190 is also suitably secured between the two members to limit their movement away from each other due to the action of the spring 160.

The bottom surface of the base member is provided with means for securing a bracket thereto whereby the exerciser 10 can be mounted on a bed frame or other suitable support at a suitable angle to facilitate operation thereof by the user. This means includes a first tubular member 200 having openings 210 at its ends. A pair of apertured brackets 220 are spaced from the tube 200 and aligned with the ends thereof. A plurality of tubes 230, 231 and 232, having rectangular cross-sections, are provided between member 200 and brackets 220. The tubes 230, 231 and 232 are parallel to each other and transverse to the long axis of the exerciser, and tube 232 has a lip 233 which is spaced from the lower surface of the base member for a purpose to be described. The other tubes might also have such lips.

Figure 1:
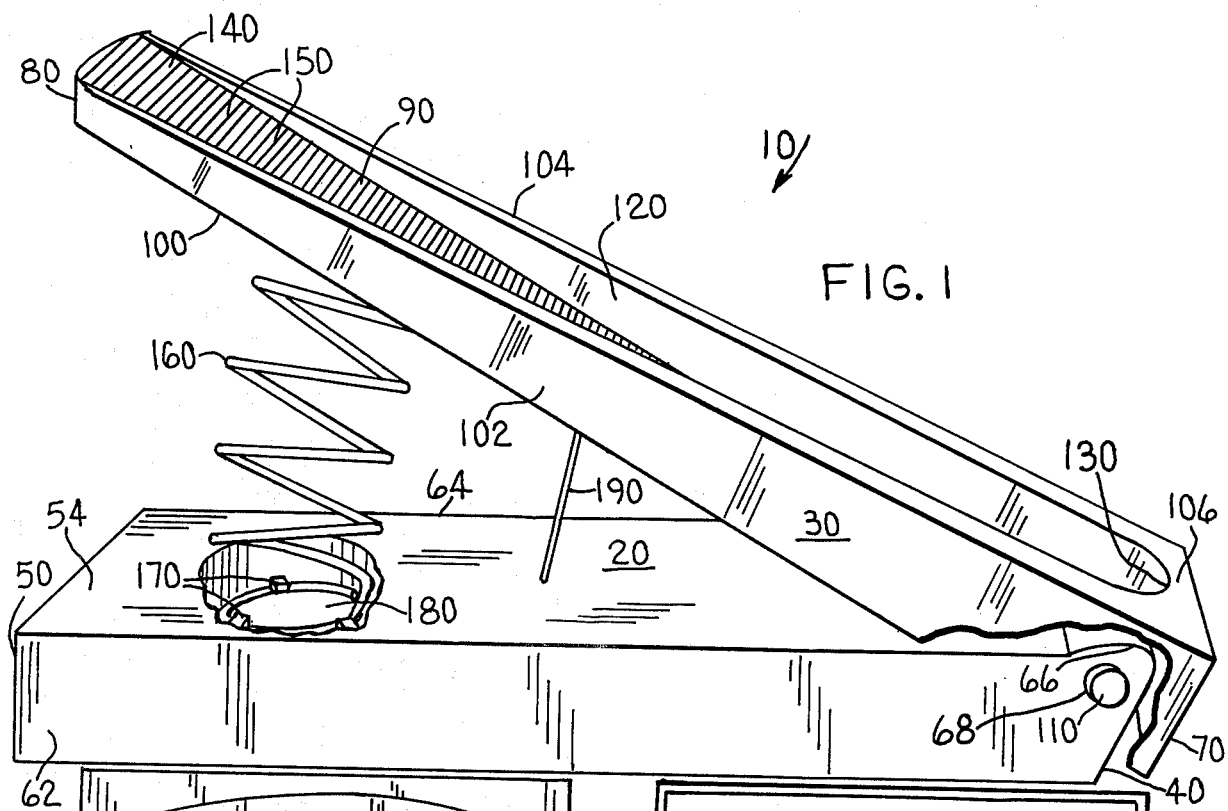
FIG. 1 is a side elevational view of the invention.
Figure 2:
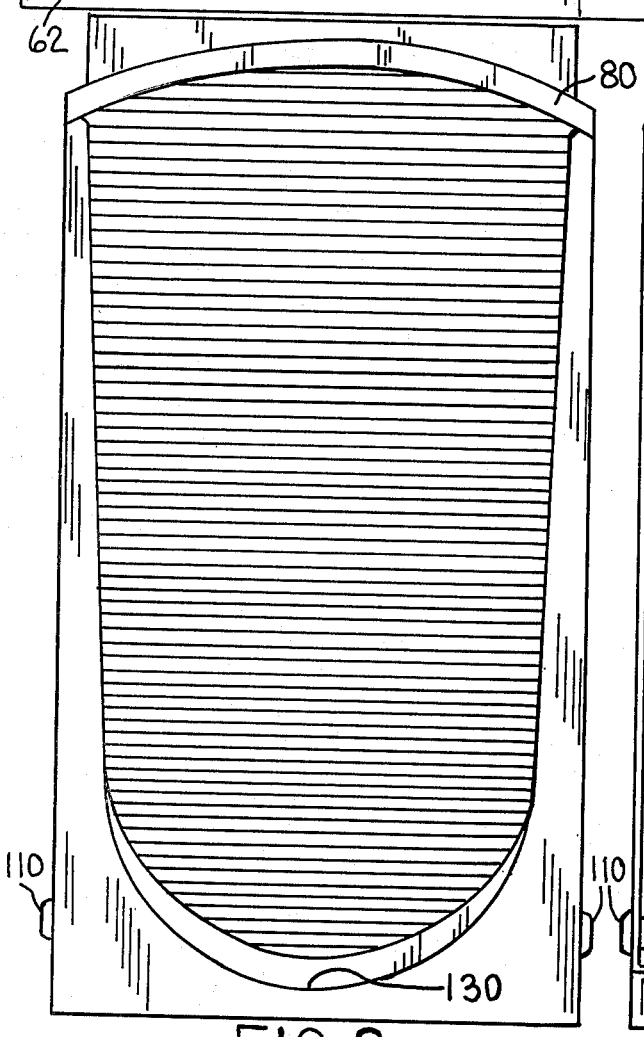
FIG. 2 is a top plan view of the apparatus of FIG. 1.
Figure 3:
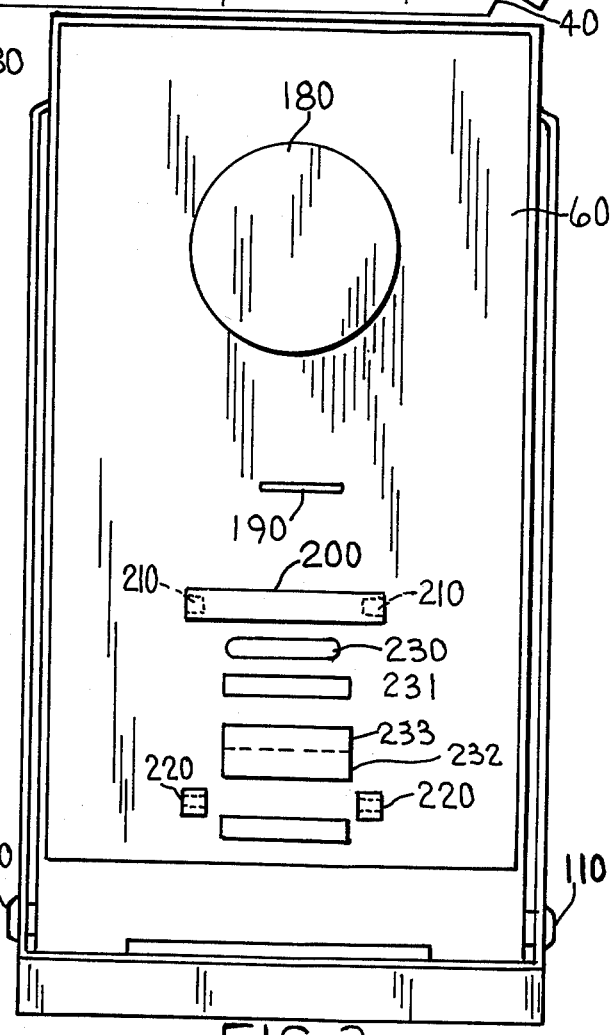
FIG. 3 is a bottom plan view of the apparatus of FIG. 1.
Figure 4:
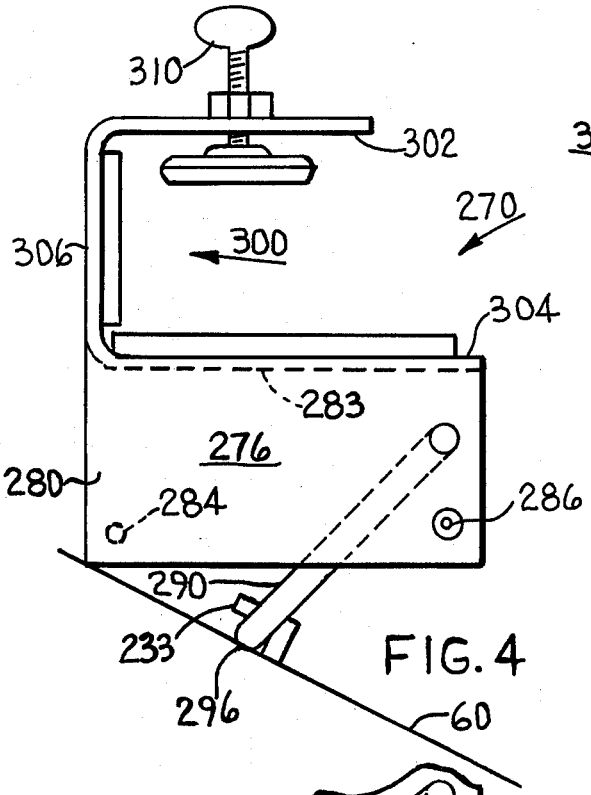
FIG. 4 is a side elevational view of a mounting bracket for use with the invention.
Figure 5:
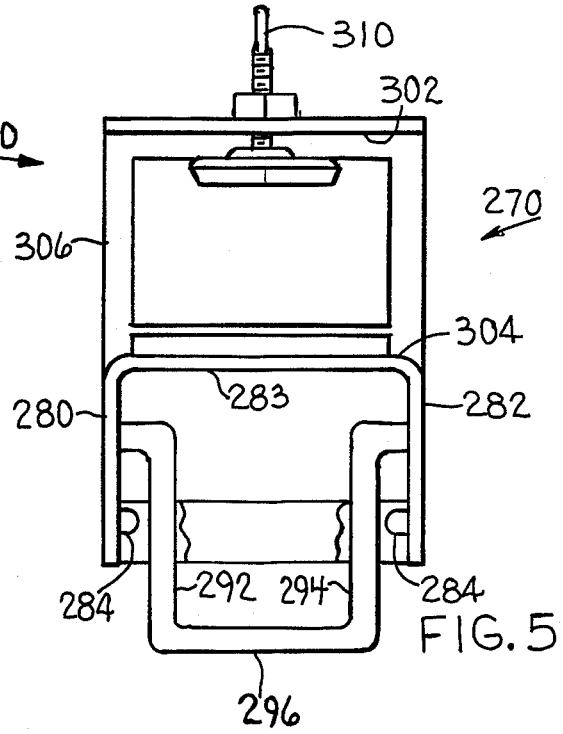
FIG. 5 is a front, elevational view of the bracket of FIG. 4.
Figure 6:
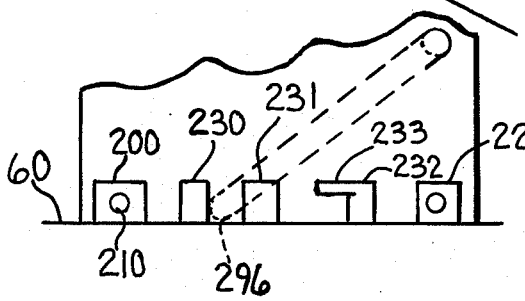
FIG. 6 is a side view of a portion of the apparatus of the invention and the bracket of FIG. 4.

A mounting bracket for exerciser 10 includes a U-shaped member 276, has a pair of side walls 280 and 282 and a base 283, and, at one end, the inner surfaces of the side walls are provided with small protuberances 284 which are adapted to be inserted in the open ends 210 of the tube 200 to lock the bracket 270 to the base member. This is illustrated in FIGS. 4, 5, and 6. In addition, at their opposite ends, the side walls are provided with apertures 286 which are aligned with the brackets 220 so that individual locking pins can be inserted therein to insure that the bracket is secured to the base member. The latter arrangement is used when the bracket is held flat to the exerciser, as illustrated in FIG. 6.

Between the walls 280 and 282 is also mounted a U-shaped bar 290 having legs 292 and 294 and a connecting portion 296. The ends of the legs of the bar are rotatably mounted in the side walls adjacent to the apertures 286. With the bracket coupled to the base member, the portion 296 of bar 290 can be inserted between tubes 200, 231 or 232 and it can lock under lip 233 (FIG. 4) whereby the angular position of the bracket with respect to the base member can be adjusted. One angular relationship is shown in FIG. 6, and another is shown in FIG. 4.

A second U-shaped member 300 having side walls 302 and 304 and a base 306 has side wall 304 secured to base 283 of member 276, with the open end of the "U" facing toward the rear of the walls 280 and 282, to which the ends of U-shaped bar 290 are coupled. The side wall 302 carries a threaded screw 310 by means of which the bracket can be clamped to the frame of a bed or the like.

Figure 7:
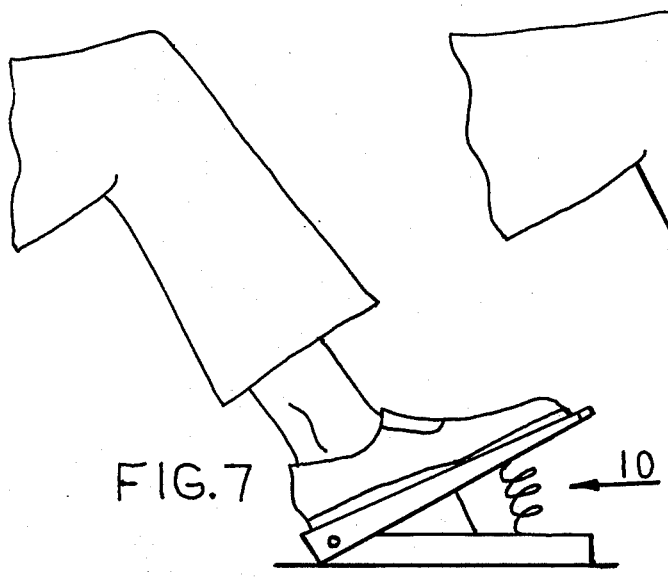
FIGS. 7 and 8 illustrate the use of the invention.

Referring to FIGS. 7 and 8, in operation of the exerciser 10, without the bracket attached, the user places the exerciser on the floor and places his foot on the top surface of the upper member and pumps up and down. The same type of exercise can be carried out with bracket 270 attached and with the exerciser clamped to a bed frame or the like at a desired angle and with the user lying in bed.

What is claimed is:

1. An exerciser comprising a first base member and a second upper member pivotally connected together, and a spring disposed between said members and normally holding them apart, said upper member being adapted to receive the foot of the user whereby the upper member can be pumped up and down to perform an exercise, said base member including means for coupling a mounting bracket thereto, said means comprising a plurality of parallel tubular members disposed parallel to each other and adapted to receive an operating portion of a mounting bracket, and a mounting bracket comprising a generally U-shaped member having side walls including means for engaging one of said tubular members for coupling the bracket thereto, and a rotatable arm for engaging others of said tubular members for disposing the bracket at an angle with respect to said base member, said bracket including locking means for clamping it to a support surface.

2. An exerciser comprising a first base member and a second upper member pivotally connected together, and a spring disposed between said members and normally holding them apart, said upper member being adapted to receive the foot of the user whereby the upper member can be pumped up and down to perform an exercise, said base member including attachment means for coupling a mounting bracket thereto, and a mounting bracket coupled to said base member, said attachment means and said bracket including portions for permitting said bracket to be pivotably coupled to said attachment means, said bracket also carrying a pivotable arm for coupling to different portions of said attachment means whereby the angular position of said bracket with respect to said base member can be varied.

3. The apparatus defined in claim 2 wherein said second member includes a top surface having a depression for receiving the foot of the user of the exerciser.

4. The apparatus defined in claim 3 wherein said top surface of said upper member carries a sheet of material which provides a frictional surface to be engaged by the foot of the user.

5. The apparatus of claim 2 and including a cord coupled between said members to limit their movement apart due to the action of said spring.

6. The apparatus defined in claim 2 wherein said base member is somewhat smaller in area than said upper member and the two members can be pressed together with the base member enclosed by said upper member.

7. The apparatus defined in claim 2 wherein said base member includes a depression in which one end of said spring is seated and secured.

8. The apparatus defined in claim 7 wherein locking tabs are provided at the base of said depression for engaging one end of said spring.

9. The apparatus defined in claim 2 wherein said attachment means comprises a plurality of parallel tubular members disposed parallel to each other and adapted to receive an operating portion of a locking bracket.

10. An exerciser comprising a first base member and a second upper member pivotally connected together, a spring disposed between said members and normally holding them apart, said upper member having a top surface shaped to receive the foot of the user whereby the upper member can be pumped up and down to perform an exercise, said base member having a top surface and a bottom surface, and attachment means on the bottom surface of said base member for adjustably coupling a mounting bracket thereto, the adjustable coupling of the mounting bracket being for adjusting the angular position of the mounting bracket with respect to said base member, said mounting bracket having means for securing it to a support member, with the net result that the exerciser, through the adjustability of the attachment of the mounting bracket with respect to the base member, may be adjustably positioned with respect to said support member.

11. An exerciser comprising a first base member and a second upper member pivotally connected together, a spring disposed between said members and normally holding them apart, said upper member having a top surface shaped to receive the foot of the user whereby the upper member can be pumped up and down to perform an exercise, said base member having a top surface and a bottom surface, a mounting bracket for said exerciser, and attachment means on the bottom surface of said base member for adjustably coupling said mounting bracket thereto, the adjustable coupling of the mounting bracket being for adjusting the angular position of the mounting bracket with respect to said base member, said mounting bracket having means for securing it to a support member, with the net result that the exerciser, through the adjustability of the attachment of the mounting bracket with respect to the base member, may be adjustably positioned with respect to said support member.

12. An exerciser comprising a first base member and a second upper member pivotally connected together, a spring disposed between said members and normally holding them apart, said upper member having a top surface shaped to receive the foot of the user whereby the upper member can be pumped up and down to perform an exercise, said base member having a top surface and a bottom surface, and attachment means on the bottom surface of said base member for adjustably coupling a mounting bracket thereto, said attachment means comprising a plurality of attachment members which are adapted to have a mounting bracket secured thereto, one portion of the mounting bracket being pivotally coupled to one of said attachment members and another portion of said mounting bracket being adapted to engage others of said attachment members with the particular attachment member engaged determining the angle through which the mounting bracket pivots with respect to said base member so that, when the bracket is clamped to a support member, the base member and the exerciser can be angularly adjustably positioned with respect to the support member.

13. An exerciser comprising a first base member and a second upper member pivotally connected together, a spring disposed between said members and normally holding them apart, said upper member having a top surface shaped to receive the foot of the user whereby the upper member can be pumped up and down to perform an exercise, said base member having a top surface and a bottom surface, a mounting bracket, and attachment means on the bottom surface of said base member for adjustably coupling said mounting bracket thereto, said attachment means comprising a plurality of attachment members which are adapted to have said mounting bracket secured thereto, one portion of the mounting bracket being pivotally coupled to one of said attachment members and another portion of said mounting bracket being adapted to engage others of said attachment members with the particular attachment member engaged determining the angle through which the mounting bracket pivots with respect to said base member, said mounting bracket having clamping means for securing it to a support member, with the net result that the exerciser, through the adjustability of the attachment of the mounting bracket with respect to the base member, may be adjustably positioned with respect to said support member.

14. An exerciser comprising a first base member and a second upper member pivotally connected together, a spring disposed between said members and normally holding them apart, said upper member having a top surface shaped to receive the foot of the user whereby the upper member can be pumped up and down to perform an exercise, said base member having a top surface and a bottom surface, a mounting bracket, said bracket having a pivotable arm, attachment means on the bottom surface of said base member for adjustably coupling said mounting bracket thereto, said attachment means comprising a plurality of attachment members which are adapted to have said mounting bracket secured thereto, one portion of the mounting bracket being pivotally coupled to one of said attachment members and said pivotable arm being adapted to engage others of said attachment members with the particular attachment member engaged thereby determining the angle through which the mounting bracket pivots with respect to the base member, said mounting bracket having clamping means for securing it to a support member, with the net result that the exerciser, through the adjustability of the attachment of the mounting bracket with respect to the base member, may be adjustably positioned with respect to said support member.

* * * * *